United States Patent [19]

Stewart

[11] Patent Number: 4,827,878

[45] Date of Patent: May 9, 1989

[54] ARTICULATED DELIVERY SYSTEM

[75] Inventor: Donald R. Stewart, Lynchburg, Va.

[73] Assignee: The Babcock & Wilcox Company, New Orleans, La.

[21] Appl. No.: 193,849

[22] Filed: May 13, 1988

[51] Int. Cl.[4] ..... F22B 37/18; F22B 37/48

[52] U.S. Cl. ..... 122/379; 15/104.32; 294/19.1

[58] Field of Search ..... 122/379; 15/104.32; 294/86.4, 19.1

[56] References Cited

U.S. PATENT DOCUMENTS 3,785,689 1/1974 Tanksley ..... 294/19.1
4,137,920 2/1979 Bonnet ..... 128/305 X
4,753,473 6/1988 Armett ..... 294/19.1

*Primary Examiner*—Edward G. Favors
*Attorney, Agent, or Firm*—Robert J. Edwards; D. Neil LaHaye

[57] ABSTRACT

An articulated delivery system for search and retrieval tooling used in recirculating steam generators. An elongated flexible snorkel is provided with at least two channels for receiving the search and retrieval tooling. Cables along the side of the snorkel and a steering device at the rear end of the snorkel provide for articulation or bending control of the forward end of the snorkel in either direction in a single plane. Rotation of the rear end of the snorkel at the steering device provides third axis control of the articulated end of the snorkel.

8 Claims, 5 Drawing Sheets

ARTICULATED DELIVERY SYSTEM

BACKGROUND OF THE INVENTION

1. Field of the Invention

The invention is generally related to inspection of recirculating steam generators and in particular to retrieval of loose parts in the annular space around the tube bundle and within a shallow penetration into the tube bundle proper.

2. General Background

Recirculating steam generators have a history of discoveries of loose parts on the secondary side face of the tubesheet during inspection. Their wide tube lanes capture or collect large pieces of debris such as machine chips, bolts, and pieces of welding wire. It is desirable that such debris be removed due to its potentially damaging effect on the tube bundle. Because access holes in the outer steam generator shell are often two inches in diameter, with little room to maneuver both inside and outside the shell hole, inspection and parts retrieval is difficult. Previous attempts at removal of parts include the use of robotic devices and fiberoptics along with a hook or prod. Robotics present limitations relative to size and maneuverability once inside the steam generator since the annular space between the tube bundle and shell inner wall is as little as four inches. Fiberoptics and hooks or prods have been inserted independently of each other without suitable means of guidance, synchronization, or articulation. It can be seen that a need exists for a more efficient means of inspecting and retrieving loose parts in steam generators.

SUMMARY OF THE INVENTION

The present invention solves the aforementioned problem by providing an articulated delivery system for search and retrieval tooling. An elongated flexible snorkel contains two or more working channels through which optics and tooling can be fed. The snorkel is constructed to have a high torsional stiffness and be stiff enough to push effectively around the annulus while having enough bending flexibility to have approximately a two and one-half inch bend radius. The last several inches of the housing can articulate more than 90 degrees in either direction in a single plane. Articulation is controlled by a steering device connected to the end of the snorkel outside of the steam generator. Third axis control and motion of the articulated end is controlled by rotation of the end of the snorkel at the steering device. A diverter or guide tube through which the snorkel is inserted may be installed in the access hole of the steam generator for deflecting the snorkel left or right to begin travel in the annular space.

In view of the above, it is an object of the present invention to provide an articulated delivery system for search and retrieval tooling which can penetrate the tube bundle for retrieval of debris.

It is another object of the invention to provide a delivery system capable of receiving a variety of search and retrieval tooling.

BRIEF DESCRIPTION OF THE DRAWINGS

For a further understanding of the nature and objects of the present invention reference should be had to the following description, taken in conjunction with the accompanying drawings, in which like parts are given like reference numerals and, wherein.

DETAILED DESCRIPTION OF THE PREFERRED EMBODIMENT

Figure 1:
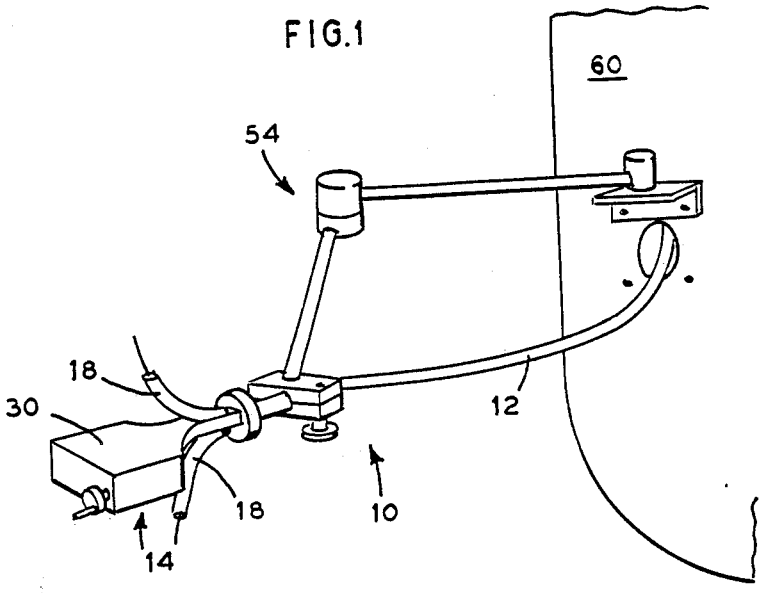
FIG. 1 is a schematic view of the invention as it appears outside a recirculating steam generator.
Figure 2:
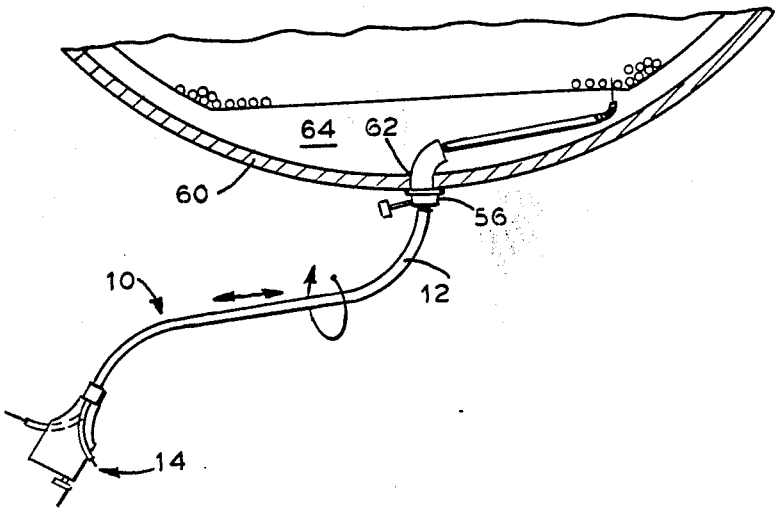
FIG. 2 is a plan view of the invention illustrating its positioning capability inside the steam generator.

Referring to the drawings, it is seen that the invention is generally referred to by the numeral 10. As best seen in FIG. 1 and 2, articulated delivery system 10 is generally comprised of snorkel 12 and means 14 for causing articulation of the forward end of snorkel 12.

Figure 3:
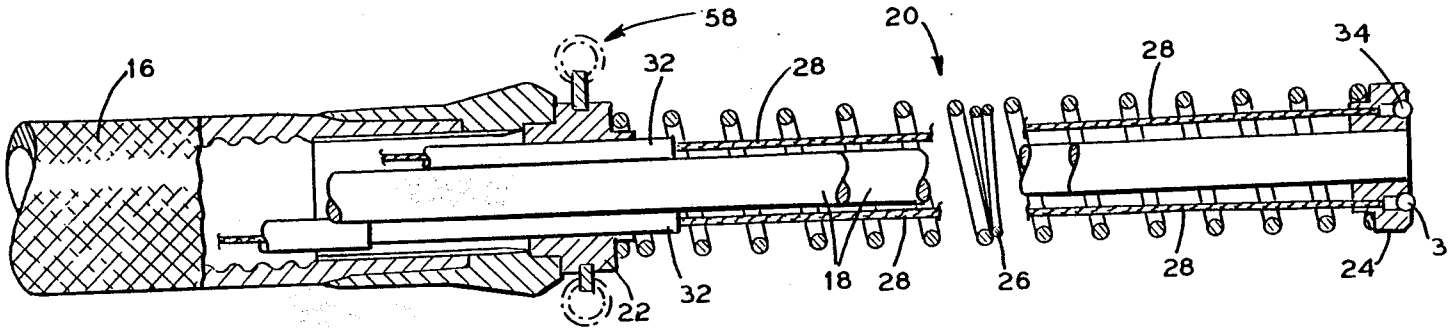
FIG. 3 is a partial cutaway view of the articulating end of the invention.

As best seen in FIG. 3 snorkel 12 is comprised of hose 16, inner channels 18, and forward articulating end 20. In the preferred embodiment hose 16 is a convoluted Teflon® hose normally used for such purposes as chemical transfer, food handling, and various processing applications. The hose is formed from a helical, convoluted Teflon® inner tubing with a reinforced stainless steel braid. The preferred size is that having a threequarter (¾) inch nominal inner diameter, a nominal outer diameter of 1.070 inches, a bend radius of approximately 2.50 inches and an overall length up to 8 feet. Inner channels 18 are preferably braided stainless steel conduit selected so that at least two inner channels 18 may be slidably fit inside hose 16. In the preferred embodiment the conduit has an inner diameter of 0.260–0.290 inches and a maximum outer diameter of 0.375 inches. Inner channels 18 are sized lengthwise to extend several inches beyond the forward end of hose 16 (five inches in the preferred embodiment) to form forward articulating end 20. Front guide fitting 22 at the forward end of hose 16 and tip guide fitting 24 serve to hold channels 18 in their relative positions to each other as they extend beyond hose 16. Front guide fitting 22 and tip guide fitting 24 may be secured to channels 18 by any suitable means such as soldering. Compression spring 26 is received between front guide fitting 22 and tip guide fitting 24 and may be secured in position by welding to each piece to prevent slippage during articulation of end 20. Two springs 26 are used in the preferred embodiment. However, this depends upon the length of end 20 and conditions expected to be encountered. Compression spring 26 serves as a means for biasing end 20 to a normally straight position when there are no forces generated to cause articulation thereof.

Means 14 for causing articulation of end 20 is provided in the form of cables 28 and steering device or articulation module 30. Cables 28 are preferably stainless steel cable slidably housed in sheath 32 and having their forward ends anchored to tip guide fitting 24 as seen at points 34 in FIG. 3. Cables 28 are positioned inside hose 16 substantially opposite each other adjacent the interior wall. In this manner, alternate pulling and loosening of cables 28 causes bending or articulation of end 20 against the biasing force of spring 26 in either direction in the single plane formed by cables 28. The alternate pulling and loosening of cables 28 is accomplished by the use of steering device 30.

Figure 4:
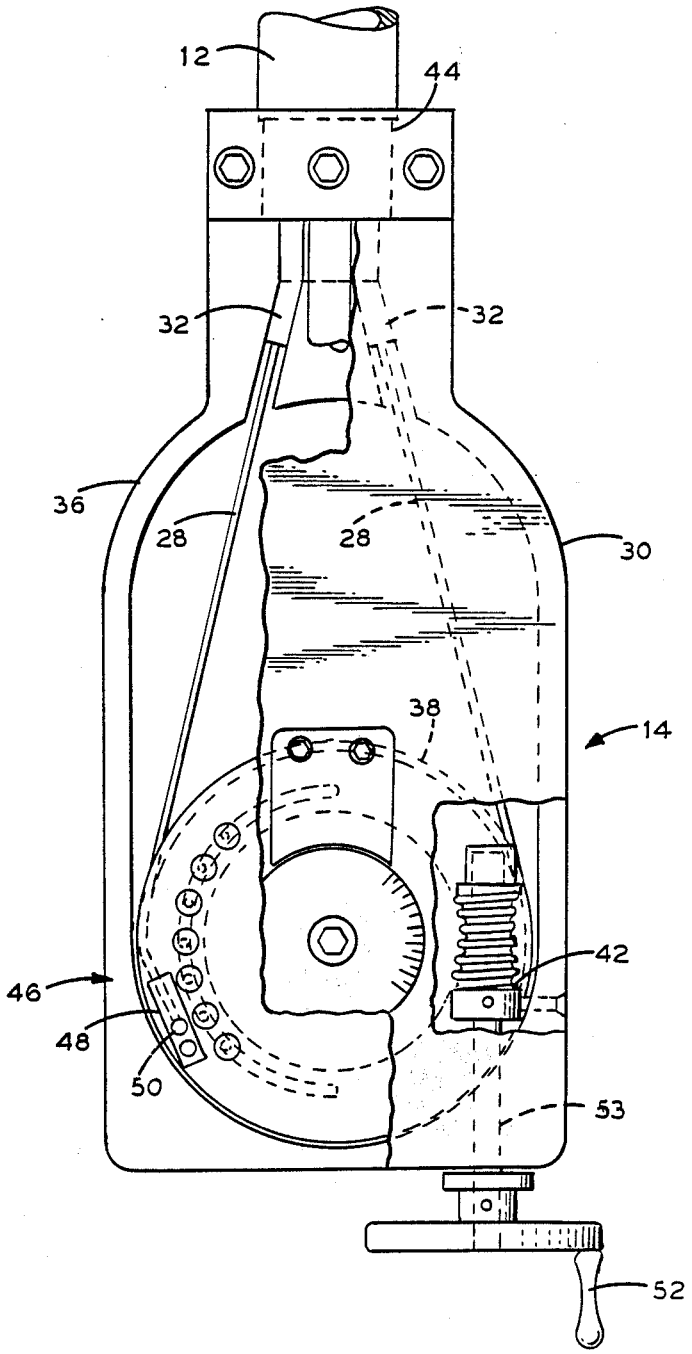
FIG. 4 is a top partial cutaway view of the steering device of the invention.

As seen in the partial cutaway view of FIG. 4, steering device 30 is comprised of case 36, pulley 38 rotatably mounted therein, drive gear 40 attached to pulley 38, and worm gear 42 acting on drive gear 40. The forward end of case 36 is tapered and provided with clamp 44 for rigidly attaching steering device 30 to snorkel 12. This allows rotation of snorkel 12 and articulating end 20 simply by manual rotation of steering device 30. In this manner, the operator is able to move articulating end 20 through more than one plane in the search for and retrieval of loose objects. Cables 28 extend from sheaths 32 inside case 36 and are each attached to pulley 38 at substantially opposite points thereon. For ease of illustration only one attachment point 46 is shown although it should be understood that both cables are similarly attached or anchored to pulley 38. Attachment may be by any suitable means such as a plate 48 brazed onto cable 28 and then attached to pulley 38 by screw 50. It can thus be seen that with cables 28 attached to pulley 38 substantially opposite each other that rotation of pulley 38 will cause pulling of one cable and loosening of the other, resulting in corresponding articulation of end 20. Rotation of pulley 38 is accomplished by turning of handle 52 by the operator in the desired direction. Handle 52 is in driving engagement with worm gear 42 by shaft 53 to cause corresponding rotation thereof. Worm gear 42, in driving engagement with drive gear 40, causes rotation of drive gear 40 and pulley 38 as pulley 38 is rigidly attached to drive gear 40.

Figure 5:
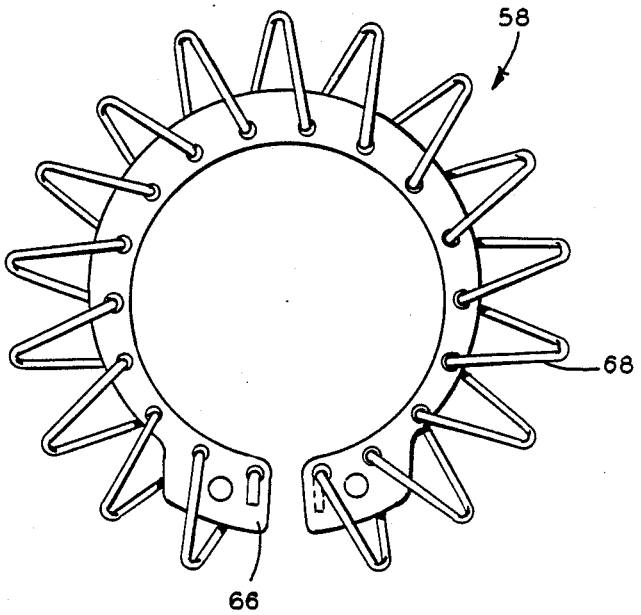
FIG. 5 is a view of the tractor band of the invention.

Additional operational use features of articulated delivery system 10 include swing-arm assembly 54, diverter 56, and tractor band 58. Swing-arm assembly 54, seen in FIG. 1, may be mounted to steam generator shell 60 and snorkel 12 adjacent to steering device 30 to allow the operator to hold and lock snorkel 12 in position for ease of operating any search and retrieval tooling within channels 18. Diverter 56, seen in FIG. 2, rotatably mounts in inspection hole 62 in steam generator shell 60 and is angled to deflect snorkel 12 in the desired direction in annular space 64. Tractor band 58, seen in FIG. 3 and 5 is comprised of spring clip 66 which removably mounts on front guide fitting 22. Wire 68 is threaded around spring clip 66 in a spiral pattern and serves to provide support to snorkel 12 during operation. This helps to keep the end of snorkel 12 out of any sludge on the lower tubesheet which may hamper operation.

In operation, the desired optical and retrieval tools are first positioned in channels 18. Snorkel 12 is then inserted into annular space 64 through diverter 56. Articulation of end 20 is accomplished through use of steering device 30 for search and retrieval of loos parts.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. An articulated delivery system for search and retrieval tooling, comprising:
   a. an elongated flexible snorkel having at least two channels therethrough for receiving said tooling;
   b. two cables positioned substantially opposite each other along said snorkel and anchored at the forward end of said snorkel;
   c. a case attached to the rearward end of said snorkel;
   d. a pulley rotatably mounted in said case;
   e. said cables being attached to said pulley;
   f. a gear in driving engagement with said pulley;
   g. a diverter which slidably receives said snorkel for deflecting said snorkel in a desired direction; and
   h. a tractor band removably attached adjacent the forward end of said snorkel.

2. An articulated delivery system for search and retrieval tooling, comprising:
   a. an elongated flexible snorkel having at least two channels therethrough for receiving said tooling;
   b. two cables positioned substantially opposite each other along said snorkel and anchored at the forward end of said snorkel; and
   c. steering means at the rearward end of said snorkel attached to said cables for alternately pulling and loosening of each cable.

3. The system of claim 2, wherein said steering means comprises:
   a. a case attached to the rearward end of said snorkel;
   b. a pulley rotatably mounted in said case;
   c. said cables being attached to said pulley; and
   d. a gear in driving engagement with said pulley.

4. The system of claim 2, further comprising a diverter which slidably receives said snorkel for deflecting said snorkel in a desired direction.

5. The system of claim 2, further comprising a tractor band attached adjacent the forward end of said snorkel.

6. An articulated delivery system for search and retrieval tooling, comprising:
   a. an elongated flexible snorkel having at least two channels therethrough for receiving said tooling;
   b. two cables positioned substantially opposite each other along said snorkel and anchored at the forward end of said snorkel;
   c. a case attached to the rearward end of said snorkel;
   d. a pulley rotatably mounted in said case;
   e. said cables being attached to said pulley; and
   f. a gear in driving engagement with said pulley.

7. The system of claim 6, further comprising a diverter which slidably receives said snorkel for deflecting said snorkel in a desired direction.

8. The system of claim 6, further comprising a tractor band attached adjacent the forward end of said snorkel.

* * * * *